United States Patent [19]

Vodra

[11] Patent Number: 4,545,606

[45] Date of Patent: Oct. 8, 1985

[54] DOOR LATCH ASSEMBLY

[76] Inventor: Richard J. Vodra, 3155 Highway 98E, Destin, Fla. 32541

[21] Appl. No.: 462,609

[22] Filed: Jan. 31, 1983

[51] Int. Cl.[4] ..... E05B 65/10; E05C 3/16

[52] U.S. Cl. ..... 292/92; 292/216; 292/221; 292/223

[58] Field of Search ..... 292/21, 92, 216, 221, 292/223, 229, 129, 191, 192, 210, 108, 254

[56] References Cited

U.S. PATENT DOCUMENTS

| | | | |
|---|---|---|---|
| 1,203,116 | 10/1916 | Hurd | 292/21 |
| 3,083,560 | 4/1963 | Scott | 292/21 X |
| 3,399,921 | 9/1968 | Trost et al. | 292/108 X |
| 3,435,643 | 4/1969 | Pollack et al. | 292/92 X |
| 3,614,145 | 10/1971 | Zawadzki | 292/92 |
| 3,663,047 | 5/1972 | Zawadzki | 292/92 |
| 3,667,793 | 6/1972 | Varrin et al. | 292/216 |
| 3,730,574 | 5/1973 | Zawadzki | 292/92 |
| 3,767,238 | 10/1973 | Zawadzki | 292/92 X |
| 4,006,471 | 2/1977 | Pappas | 292/92 X |
| 4,083,590 | 4/1978 | Folger | 292/92 |

*Primary Examiner*—Robert L. Wolfe

*Attorney, Agent, or Firm*—Cullen, Sloman, Cantor, Grauer, Scott & Rutherford

[57] ABSTRACT

In combination with a door hinged at one edge within a door jamb with a latch assembly mounted upon a closing edge and a strike on the jamb in registry with the latch assembly which comprises a latch within a housing pivotally mounted upon the door upon a first axis and projecting from the housing and having a lock position receiving the strike and normally biased towards an unlocked position, the strike on closing the door rotating the latch to its locking position, there being a locking aperture upon the latch. A yoke, normally biased towards a locking position and rotatable to an unlocked position is pivotally mounted upon the housing upon a second axis and mounts a latch pin adapted for interlocking registry with the lock aperture when the latch is in locking position. A spring biased reciprocal latch bar has an actuator which is adapted on retraction to retract the yoke to an unlocked position, the latch being free to move to its unlocked position on opening of the door relative to the strike. A manually operated control is mounted upon the housing and connected to the latch bar for retracting it.

27 Claims, 15 Drawing Figures

FIG. 14
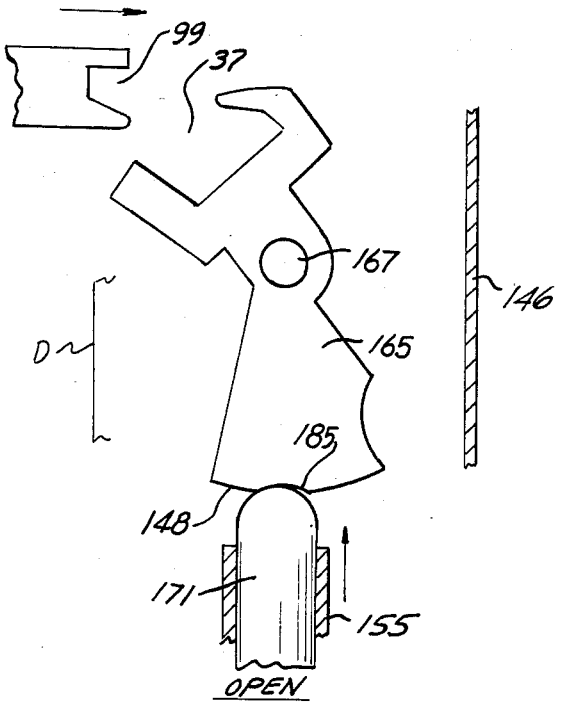
FIG. 15
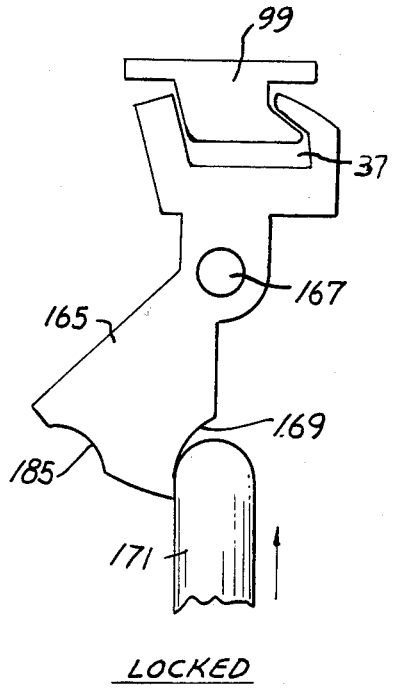
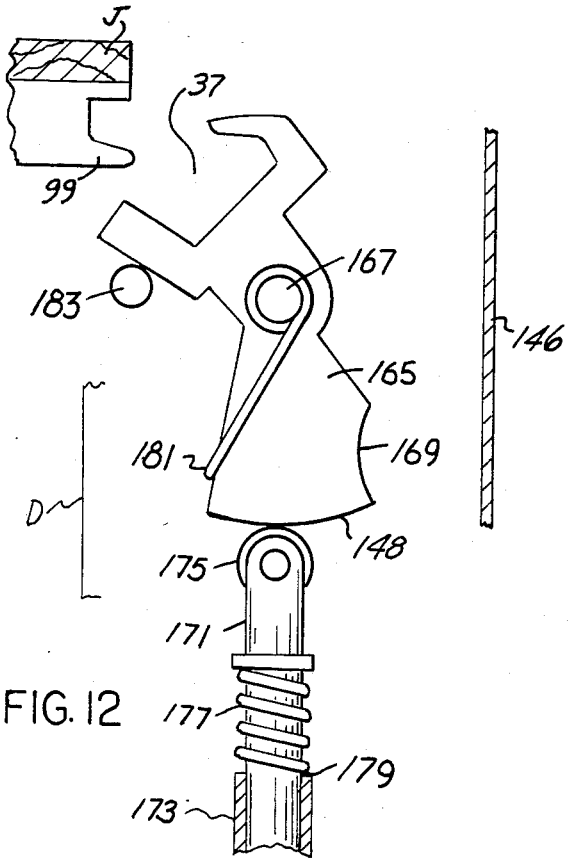
FIG. 12
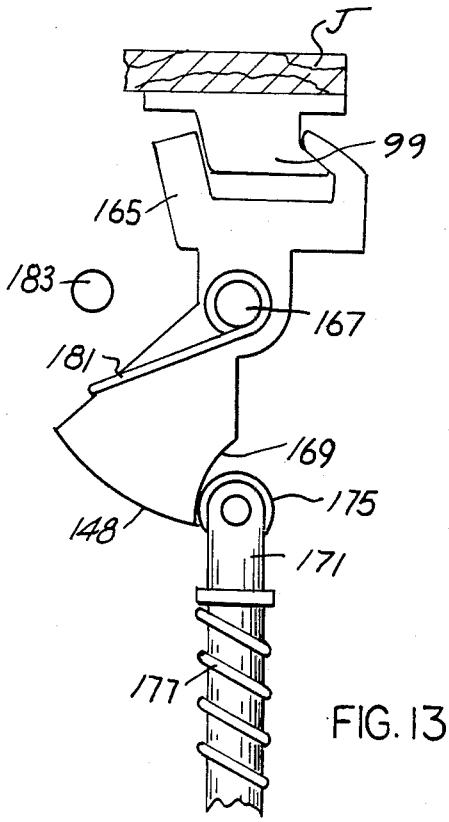
FIG. 13

DOOR LATCH ASSEMBLY

BACKGROUND OF THE INVENTION

Heretofore door latch assemblies for doors include a latch which is normally spring biased to a locking position and which may be manually retracted in various ways even when the door is closed. Heretofore devices have been provided for preventing the latch from being manually retracted to prevent unauthorized passage through the doorway. Heretofore even in situations as this, the use of a crowbar or other tool upon the door jamb has been sufficient to bend the jamb to disengage the latch from the strike upon the door jamb permitting unauthorized entry. Conventional latches do not provide good security often necessitating the use of dead bolts and guard chains.

Heretofore door latch assemblies have been employed in connection with touch bar or panic bar actuators positionable upon the interior of a door, such as at a school or public place, wherein the latch mechanism may be retracted from the interior of the building to permit exit thereform.

THE PRIOR ART

Examples of door latch assemblies and panic exit devices or push bar devices may be seen from one or more of the following United States patents:

| U.S. PAT. NO. | NAME | DATE |
|---|---|---|
| 2,328,936 | Emory O. White | September 7, 1943 |
| 3,024,053 | D.E. Cox et al | March 6, 1962 |
| 3,614,145 | George Z. Zawadzki | October 19, 1971 |
| 3,663,047 | George Z. Zawadzki | May 16, 1972 |
| 3,730,574 | George Z. Zawadzki | May 1, 1973 |
| 3,854,763 | George Z. Zawadzki | December 17, 1974 |
| 4,006,471 | Michael Pappas | February 1, 1977 |
| 4,083,590 | Roger J. Folger | April 11, 1978 |
| 4,181,335 | Laurence R. Thoren | January 1, 1980 |
| 4,167,280 | Max Godec, Stephen G. Branson | September 11, 1979 |

SUMMARY OF THE INVENTION

An important feature of the present invention is to provide an improved door latch assembly including a positive locking mechanism which is tamper proof and therefore prevents unauthorized entry through the door opening.

A further feature is to provide tamper proof door latch assembly which provides more security against unauthorized entry than a combination deadbolt and chain guard. The tamper proof interlocking grip action between the strike and latch secures the door to the jam in all directions prohibiting entry by crowbar prying. The latch may not be manually retracted. At the same time the release mechanism is so gentle that the present door latch assembly and strike exceeds national standards for safety. One of these standards is that all push bars or panic bars must operate with a force less than 15 pounds along the length of the push bar and that the bar must have a length at least equal to one-half of the width of the door. The latch may not be retracted by spring action.

There is further provided a latch assembly which will release with no more than 50 pounds pressure applied at a point half of the width of the door away from the door strike while 250 pounds of pressure is being applied against the inside of the door at the latch location. The present latch assembly is particularly adapted for emergency exit devices.

A further feature of the present invention is to provide in the latch assembly a gripper latch which interlockingly engages the strike within the door frame in such manner as to positively prevent retraction of the latch unless properly unlocked.

A further feature of the present latch assembly is to provide a pivotal latch mounted upon a housing applied to the interior side of a door mounted for rotation about a first axis and on a portion thereof having a lock aperture. A guard is pivotally mounted upon the same axis adjacent the latch and has a lock position normally closing the lock aperture of the latch. The guard may be pivoted to a locked position on closing the door and upon engagement of the strike with the latch. There is employed a locking yoke pivotally mounted upon the housing, upon a second axis parallel to the first axis and including a lock pin which is so positioned and biased as to automatically move into interlocking position within the lock aperture of the latch when the latch and the guard have been moved to locking positions.

A further feature of the present door latch assembly includes the use of spring biased retractive latch bar within the housing having an actuator engageable with the yoke together with some movable means upon the housing or door connected to the latch bar for retracting its actuator for moving the yoke to it unlocked position disengaging the latch.

A further feature contemplates the use of various types of movable devices for releasing or unlocking the latch which include a panic bar or push bar, the use of a solenoid or the use of a lever handle or knob or any other movable means which has the function of retracting the latch bar to such position as to disengage the yoke and the locking pin carried thereby.

These and other objects and features will be seen from the following Specification and claims in connection with the appended drawings.

THE DRAWINGS

FIG. 12 is a fragmentary side view of a modified latch assembly.

FIG. 13 is a similar view with the latch assembly locked.

FIG. 14 is a fragmentary view of a further modified latch assembly

FIG. 15 is a similar view with the latch assembly in lock position.

It will be understood that the above drawings are illustrative of one embodiment of the invention and mode of operation, and that other embodiments are contemplated within the scope of the claims hereafter set forth.

DETAILED DESCRIPTION OF AN EMBODIMENT OF THE INVENTION

Figure 2:
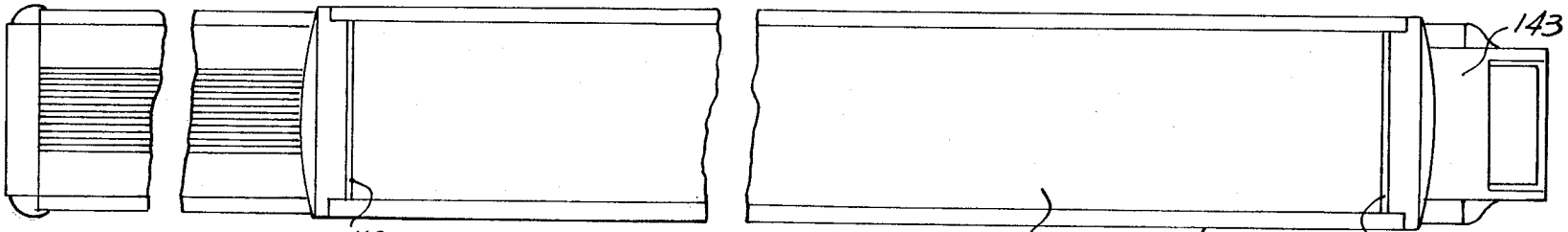
FIG. 2 is a fragmentary side view taken in the direction of arrows 2—2 of FIG. 1.
Figure 3:
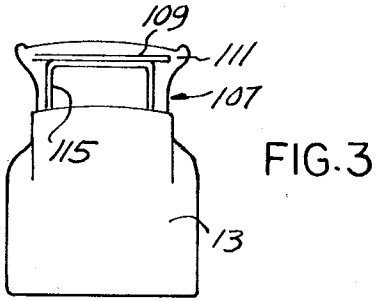
FIG. 3 is an end view thereof.
Figure 1:
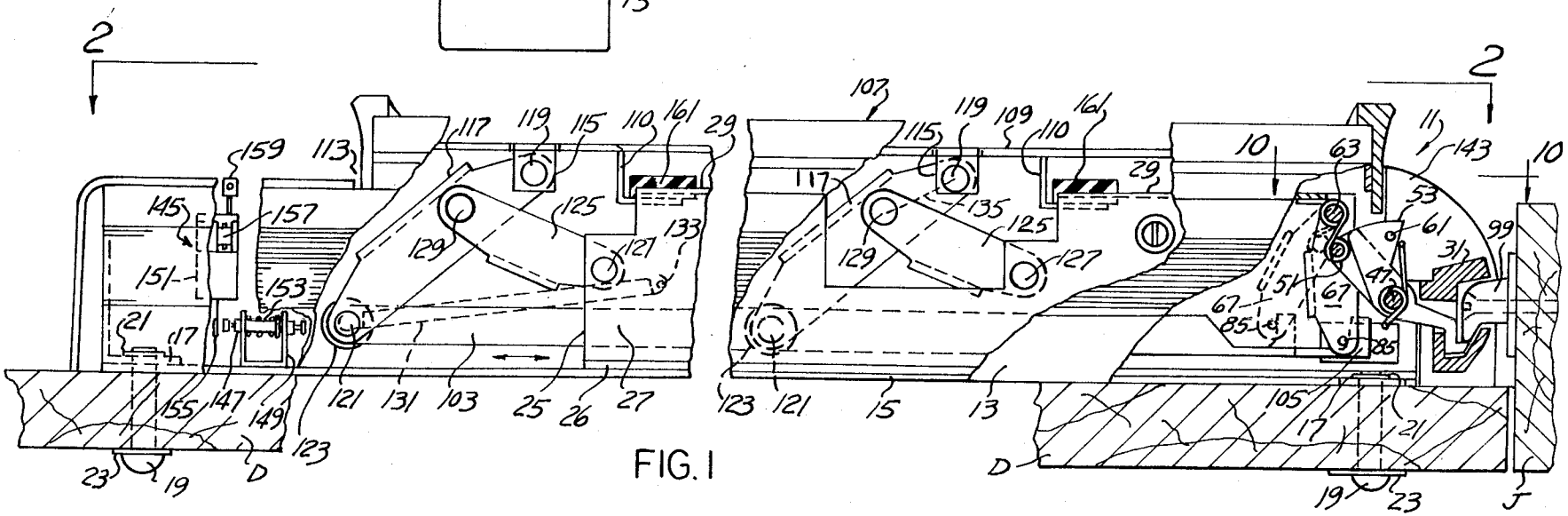
FIG. 1 is a fragmentary plan view of the present door latch assembly that is mounted upon a door and operated by a push bar upon the interior of the door.

Referring to the drawings and particularly FIGS. 1, 2 and 3, the present door latch assembly is generally indicated at 11, FIG. 1 and is mounted upon the door D, fragmentarily shown, which is hinged along one edge in a conventional manner within a door jamb J. The latch asembly is mounted upon the door at its closing edge and is in registry with a strike 99 mounted upon the corresponding surface of door jamb J, as shown in FIG. 1.

Housing 13, constructed of an aluminum extrusion, for illustration, has a base plate 15 in registry with the inner surface of the door D and a plurality of corresponding apertured mount flanges 17 by which the housing is secured to the door by bolts 19. These extend through trim 23, through corresponding apertures in the door, through the mount flanges and are secured thereon by C-clips 21, for illustration. The bolts may be otherwise secured to the mount flange as by nuts or by threading.

Figure 4:
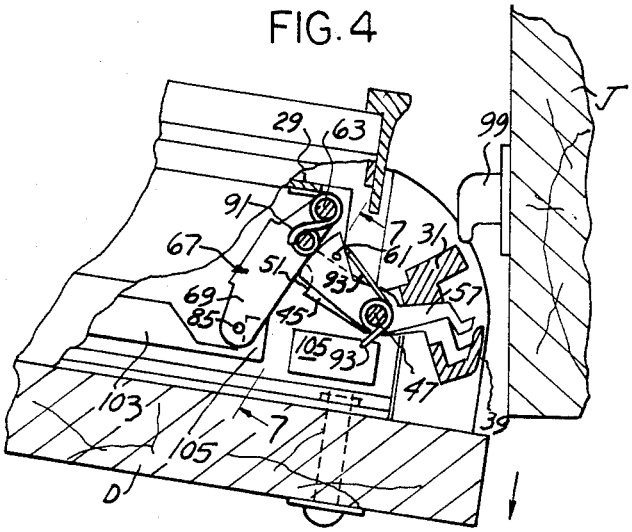
FIG. 4 is a fragmentary plan view illustrating the latch of FIG. 1, with the door open, on an increased scale.
Figure 8:
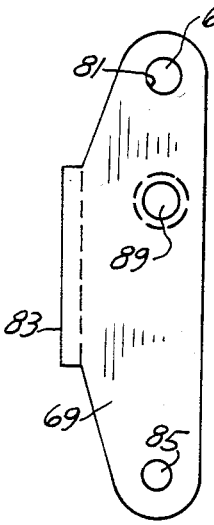
FIG. 8 is a side elevational view thereof.

Base support bracket 25 of inverted U-shape with outturned flanges 26 is suitably secured within housing 13 and includes a pair of opposed spaced parallel side plates 27 interconnected by the spanner 29, FIGS. 1 and 4. Latch assembly 30, FIG. 11 includes elongated latch 31, FIGS. 1, 4 and 5, of general T-shape in plan and including body 33 constructed of stainless steel. Said latch has in lock position, shown in FIG. 1 and release or unlocked position shown in dash lines in FIG. 11. The ends of the body 33 have mounted thereon suitable reinforcing side plates 35 (FIG. 10) of steel and are retained in position by fasteners 36, FIG. 5.

Figure 5:
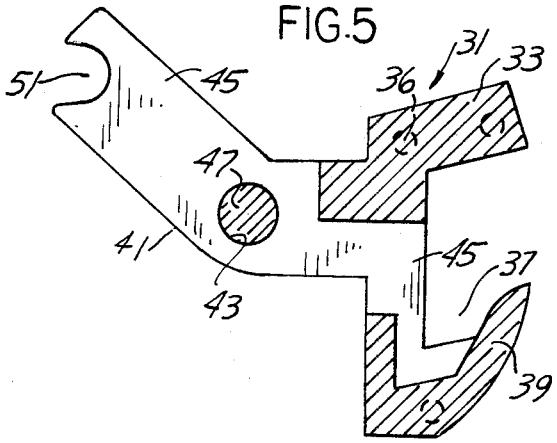
FIG. 5 is a central longitudinal section of the latch shown in FIG. 1, on an increased scale.
Figure 11:
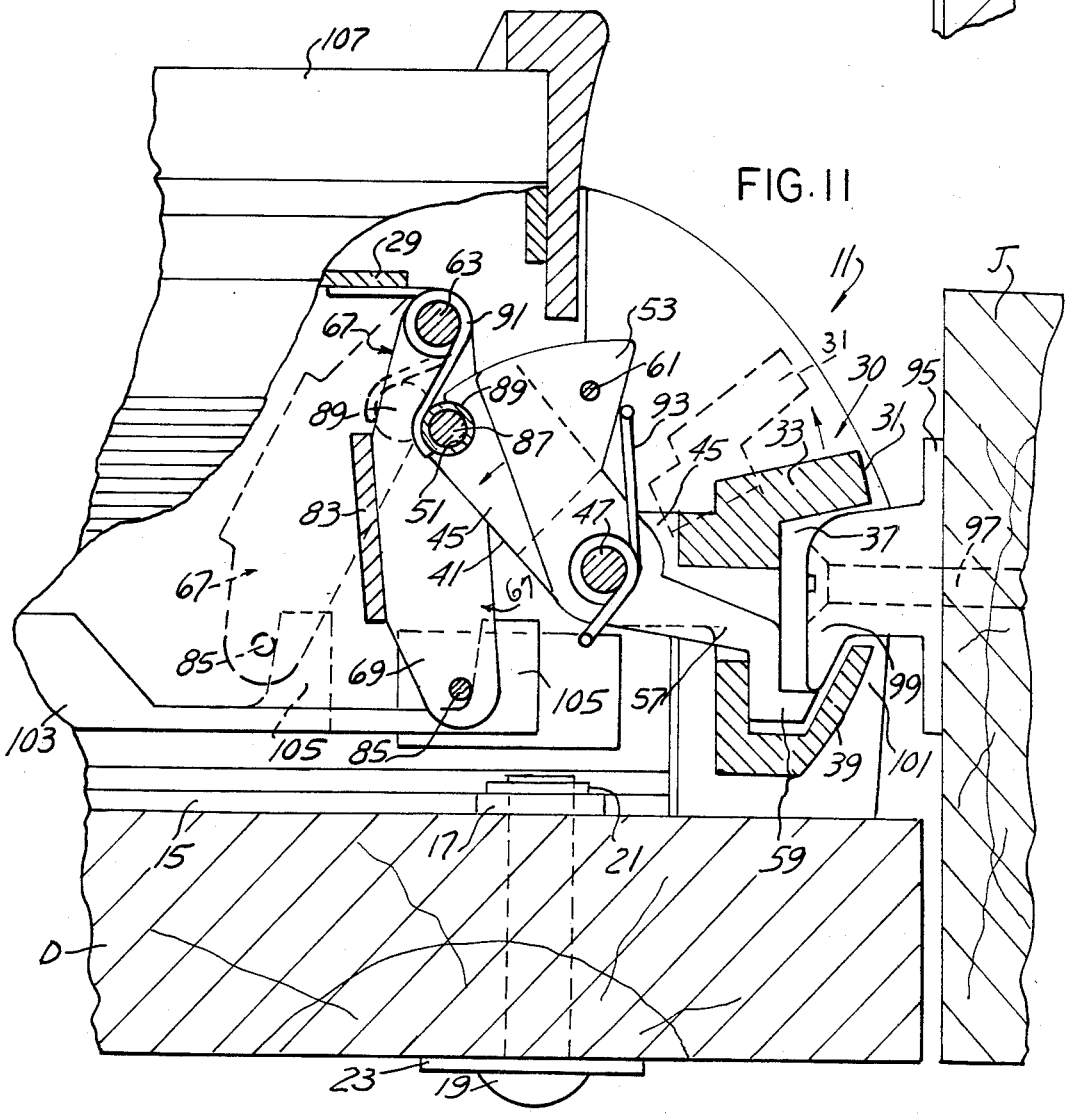
FIG. 11 is a fragmentary view of the latch and guard with the door opened.

The body of the latch at the portion which projects outwardly of the housing 13 has an undercut lock chamber 37, FIGS. 5 and 11 which defines on the forward arcuate portion of the latch body 33 a retaining lip 39. The latch body terminates in the elongated angular latch arm 41, FIG. 5, and includes a central longitudinal slot 45 which extends the length of the latch arm and at one end communicates with the undercut lock chamber 37, FIGS. 1 and 5.

Said latch arm has a transverse bore 43 which receives pivot pin 47 which extends between and spans bracket side walls 27 and is suitably secured thereto. Nylon washers 49 are mounted upon pivot pin 47 and interposed between opposite ends of the latch body 33 and support side walls 27. The inner end portion of the latch arm 41 has a transverse elongated lock aperture 51 therein, FIG. 5.

Figure 6:
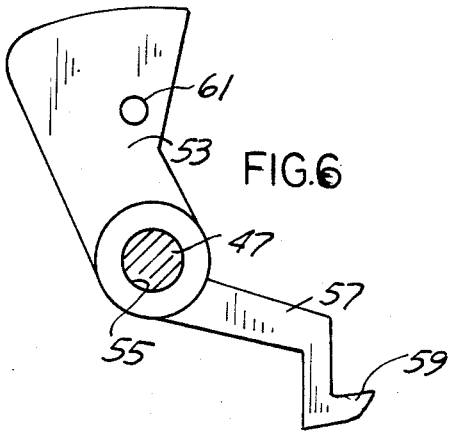
FIG. 6 is a side elevational view of the guard shown in FIGS. 1 and 4 on an increased scale.

Guard or guard plate 53, FIGS. 1, 4 and 6 has a transverse aperture or bore 55 and upon one end the cantilever control arm 57 terminating in the angular detent 59. In the illustrative assembly shown in FIGS. 1 and 4, the guard is positioned within the latch longitudinal slot 45 and is pivotally mounted upon the same pivot pin 47 which corresponds to a first axis and the pivotal mounting of the latch 31.

Mounted upon guard 53 and projecting from opposite sides thereof is a roll pin 61, FIGS. 1, 6 and 11.

A lock release mount pin 63, sometimes referred to as a pivot pin, extends between and is mounted upon and spans the side walls 27 of the support 25 upon a transverse axis parallel to the first axis corresponding to pivot pin 47 and is secured to the bracket by a pair of C-clips 65 nested within annular slots in outer end portions of the lock release mount pin 63, sometimes referred to as the second pivot pin.

Lock yoke 67 is nested within support side walls 27 and at its upper end is pivotally mounted upon second pivot pin 63 and is shown in FIG. 11 in the solid line lock position and in dash lines in its release position. Said yoke includes a pair of parallel spaced yoke arms 69 apertured at their one ends at 81 receiving the second pivot pin 63 and interconnected by the spanner plate 83.

Figure 7:
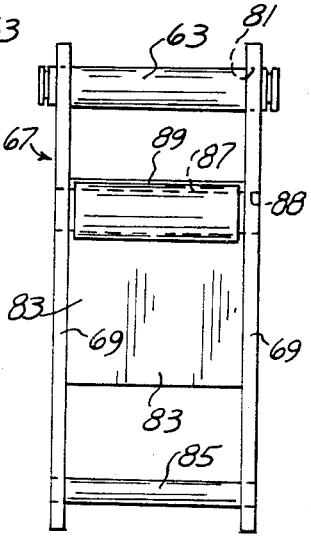
FIG. 7 is a front view of the lock pin mounting yoke taken in the direction of arrows 7—7 of FIG. 4, on an increased scale.

Cross pin 87 spans yoke arms 69 and at its ends is secured within yoke arm apertures 88 and mounts thereon the stainless steel lock roller or lock pin 89, FIGS. 1 and 7. It is so positioned with respect to the lock aperture 51 of the latch 31 as to be interlockingly nested within the lock aperture 51 when the latch is in its lock position shown in FIG. 11 and the guard 53 is in its lock position.

When the guard 53 is in its unlocked position, it is so positioned with respect to the latch 31 and latch arm 41 within slot 45 thereof as to cover and block the lock aperture 51 of the latch to prevent entry of the lock roller or pin 89 thereinto.

In operation, when the door is swung closed to the lock position shown in FIG. 11, the closing action of the door with respect to the strike 99 rotates the latch 31 from the unlocked position shown in dash lines in FIG. 11 to the solid line locking position. At the same time during such closing of the door with respect to the strike 99 said strike is projected into the lock aperture 37 of the latch and operatively engages the detent 59 upon control arm 57. This causes the guard 53, to mechanically move from the position wherein it blocks lock aperture 51, to a non-blocking position shown in FIG. 11.

At this point, since the yoke 67 carrying the lock roller or pin 89 is normally biased to a locking position i.e., counterclockwise with respect to FIG. 11 the latch will be automatically locked in its locking position with the lock pin 89 retainingly nested within and along the length of the transverse lock aperture 51 within latch 31. Yoke 67 is sometimes referred to as latch retaining means.

The biasing means for the yoke 67 in the illustrative embodiment is a coil spring 91, FIG. 11 which is centrally mounted upon the second pivot pin 63 within bracket side walls 27 and at one end retainingly engages the underside of the spanner 29 between said side walls. The opposite end of the spring 91 operatively engages a portion of the yoke 67 such as shown at 91 in FIG. 11 so that at all times, said yoke is biased toward the solid line position shown in FIG. 11 from the unlocked dash line position shown. While the yoke may be at all times biased towards the locked position, it cannot move to the lock position with its lock pin 89 moving into the lock aperture 51 of the latch until two things occur. The latch must be in the lock position shown in FIG. 11 and at the same time the guard 53 must be in the lock position shown in FIG. 11 uncovering lock aperture 51 in said latch.

Figure 10:
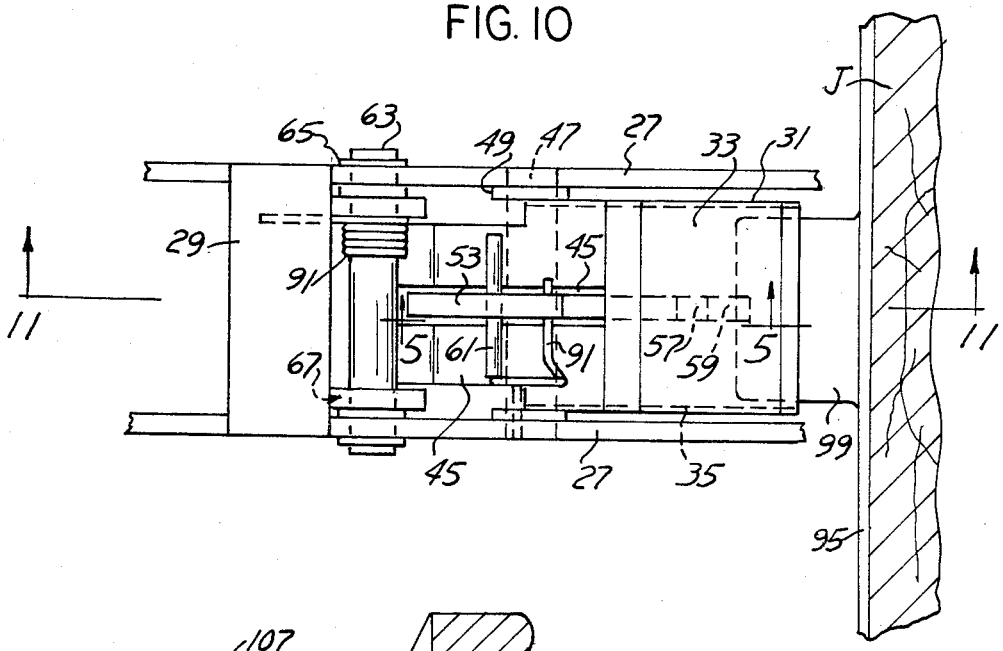
FIG. 10 is a fragmentary section taken on line 10—10 of FIG. 1.

Biasing of the latch 31 and the corresponding guard 53 is obtained by a heavy duty latch and guard return spring 93, FIGS. 10 and 11 which is mounted upon the pivot pin 47 and at one end engages the base support bracket 25 between the bracket side plates 27. Its other end is in operative engagement with the guard 53.

Thus, the guard 53 is normally biased to an unlocked position so that it covers or blocks the lock aperture 51 of the latch 31 and as moved to such unlocked position roll pin 61 upon the guard is in operative engagement with the upper surface of the latch arm 45 so as to bias the latch to the dash line unlocked position shown in FIG. 4.

Mounted upon the jamb J, fragmentarily shown in FIGS. 1 and 4, and in opposing registry with the latch assembly 30 is the elongated strike plate 95 secured to the jamb by fasteners 97 and which is normally arranged in opposing registry with the latch assembly.

As shown in FIGS. 10 and 11, projecting from the latch bar centrally thereof is a formed strike or strike bar or boss 99, which as shown in FIG. 11, is spaced from the strike plate 95 and is thereby adapted for interlocking projection within the undercut lock chamber 37 within the latch body 33 for cooperating interlocking engagement with the retaining lip 39. Said lip 39 cooperatively extends into the undercut recess 101 defined between strike 99 and strike plate 95, FIG. 1.

Movably positioned, and in the illustrative embodiment slidably mounted upon base plate 15 of housing 13 is an elongated drive link or latch bar 103 which has at its outer end an upturned actuator 105 which is normally arranged in advance of the cross pin 85 which interconnects to the lower ends of the yoke arms 69 of yoke 67. Bar 103 is sometimes referred to as latch means.

For unlatching or unlocking the door, when in the locked condition, such as shown in FIG. 11, it is necessary that the latch bar 103 be in some manner retracted from the position shown in FIG. 1 so that the actuator 105 operatively engages pin 85 of the yoke 67. This is for the purpose of rotating the yoke to the dash line position which moves the lock pin assembly 87, 89 out of registry from the lock aperture 51 in the end of latch 31.

In the illustrative embodiment, the latch bar 103 is spring biased to the position shown in FIG. 1 by return spring 131 connected to the latch bar as at 121 and at its other end connected as at 133 to some portion of the housing 25.

Figure 9:
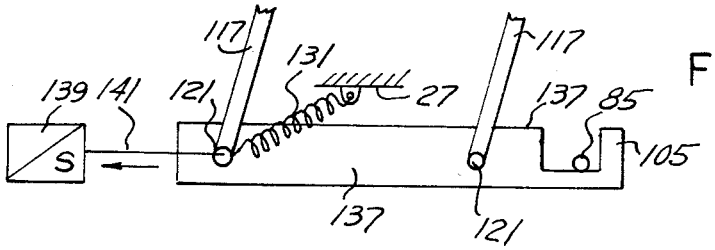
FIG. 9 is a fragmentary schematic view illustrative of a solenoid retracted latch bar.

The latch bar 103 may be retracted in various ways such as with a touch bar 109 as shown in FIGS. 1, 2 and 3, or by a solenoid such as shown schematically in FIG. 9 or by the actuation of a knob or a lever handle which upon movement will effect a retracting movement of the the latch bar 103 from the position shown in FIG. 1 tensioning the spring 131, for automatic return when disengaged.

In the illustrative embodiment disclosed herein, there is provided a touch bar assembly 107 as one movable means upon the housing 13 which is connected to the latch bar by a suitable linkage for retracting the actuator 105 and for moving the yoke 67 to an unlocked position disengaging the latch such as shown in dash lines in FIGS. 1 and 11.

The touch bar assembly 107 includes an elongated touch bar 109 which is parallel to latch bar 103 and spaced therefrom and movably positioned within the elongated rectangular aperture 113 formed within housing 13 upon the outer surface thereof.

A pair of longitudinally spaced depending support channels 115 are secured to undersurface portions of the touch bar 109 and are pivotally and flexibly connected to the latch bar 103 by a parallelogram type of linkage, shown in FIG. 1.

Said parallelogram linkage includes a pair of longitudinally spaced parallel drive yokes 117 pivotally connected to the push bar 109 by the transverse pivot pins 119 which extend across and are supported upon the support channels 115.

The drive yokes 117 are inclined downwardly and inwardly at an acute angle with respect to the latch bar 103 and are pivotally connected thereto at their ends as by the pivot pins 121. On each of the pivotal connections 121 between the drive yokes 117 and the latch bar 103 there are arranged nylon rollers 123 which space the latch bar 103 above the base plate 15 of the housing with the nylon rollers movably engaging base plate for a minimum of friction.

The parallelogram linkage includes a pair of longitudinally spaced drive rockers 125 which are parallel and are pivotally connected to portions of the base support as by the pivots 127, FIG. 1 and connected to the drive yokes 117 intermediate their ends as by the pivot pins 129.

Since the return spring 131 is urging the latch bar 103 to the position shown in FIG. 1, the touch bar 109 will normally be supportably and movably positioned within the outer wall of the housing 13 shown in FIG. 1 within the slot 113 therein.

It is this construction which supportably mounts the push plate or touch bar 109 so that upon inward manual force applied thereto anywhere along its length, the push plate 109 while remaining parallel to the latch bar 103 will move inwardly. The drive yokes 117 are constrained by the drive rockers 125 for limited forward movements for effecting a rectilinear retracting movement of latch bar 103. This in turn, translates the latch bar 103 rearwardly with a corresponding rearward retracting movement of the actuator 105 which operatively engages the yoke pin 85 rotating the yoke to the dash line release or unlocked position shown in FIG. 1. This automatically disengages the lock pin assembly 87, 89 from the latch lock aperture 51. Any manual outward pressure then applied to the door, such as through the touch bar 109, causes an opening movement of the door D and at the same time the latch body 31 is disengaged from the strike 99 as the door begins to open so that the latch under its spring bias rotates to the dash line position shown in FIGS. 4 and 11.

For proper operation of the parallelogram linkage, the pivotal connection 129 between the drive yokes 117 and drive rockers 125 is such that the distance between the pivots 119 and 129 designated at 135 is less than $\frac{1}{2}$ the length of the drive yoke 117.

Just as soon as the touch bar 109 is released after the door has been opened, the pressure upon the parallelogram linkage is eliminated and the coil spring 131 automatically returns the latch bar 103 to the position shown in FIG. 1. At the same time with the door open, under its spring bias 93 the latch 31 is automatically moved to the dash line position shown in FIG. 11 corresponding to an unlocked position. Through said linkage touch bar 109 returns to its initial position limited by the stop plates 110 engaging base support 25.

As soon as the door closes on moving in the opposite direction, the retracted latch body 33 operatively engages the strike 99 causing the latch to move back to the lock position shown in FIG. 11, wherein the strike 99 is projected into the outwardly opening undercut lock chamber 37.

Since the strike 99 has moved to the interlocked position with respect to the latch 31 as shown in FIG. 11, there is an automatic relocking of the latch with respect to the door and jam. During the closing operation the relative position between the strike 99 and the latch is such that said strike has operatively engaged the detent 59 of the guard 53 and has rotated the guard to the locking position shown in FIG. 11 so that the locking pin assembly 87, 89 under is spring bias 91 is free to move into interlocking registry within the lock aperture 51 of the latch.

It is contemplated that other movable means may be employed for effecting controlled retraction of the latch bar 103. For example, the latch bar 103 could be retracted by operation of the lever handle or knob, or could be retracted in the manner shown in FIG. 9.

Here, the modified latch bar 137 is supported by and controlled by the parallelogram linkage 117 fragmentarily shown, is spring biased by the spring 131 to a position corresponding to the position shown in FIG. 1. The movable means in this illustration is the solenoid 139 whose plunger 141 is pivotally connected as at 121 to the latch bar 137. Upon energization of the solenoid 139 through a suitable switch or contact, the latch bar 137 is retracted so that its actuator 105 operatively engages the transverse pin 85 on the yoke 67 for retracting the yoke to the unlocked dash line position shown in FIG. 11.

In the illustrative embodiment, there is a formed nose piece 143 on the forward end of the housing which overlies and protectively encloses the latch assembly 31. The present latch assembly may be used upon any type of door, such as aluminum, wooden, glass doors or the like or any metal door.

The strike 99 has an elongated boss snugly positioned within the undercut lock chamber 37 of the latch body 33 and is in cooperative interlocking engagement with the lip 39 of the latch body. The cooperative interlock between the strike 99 and the lip 39 and the positioning of the strike 99 within the outwardly opening aperture 37 of the latch provides a positive lock arrangement for the latch assembly.

The latch cannot be rotated to the dash line unlocked position shown in FIG. 1, unless and until the yoke 67 has been retracted in some manner to the dash line position shown in FIG. 1.

While the yoke 67 is shown in the illustrative embodiment as being spring biased by the coil spring 91, it is contemplated that the yoke could be biased into locking position in various other ways. For example, instead of a spring, the yoke could be biased by its weight, or weighted so as to be biased to the locking position shown, or could be so counterbalanced as to be normally biased towards the locking position shown.

While the guard has been shown pivotally positioned for pivotal movement relative to the latch within the central longitudinal slot 45 therein, it is contemplated that the guard could be otherwise positioned with respect to the latch so as to be adjacent thereto so in such position as to cover or block the lock aperture 51 in said latch preventing entry of lock pin 89.

ALARM SYSTEM

An alarm system 145 is schematically shown in FIG. 1, to indicate an unauthorized movement of the touch bar 109 and latch bar 103.

Alarm actuator pin 147 is guidably mounted upon bracket 149 on plate 15 spaced from and in alignment with latch bar 103. If latch bar 103 is retracted when the alarm 151 is on, it engages pin 147. Said pin is advanced against spring 153 into an engagement with alarm contact 155 activating alarm 151. Said alarm has a battery 157 or other power source. For normal use of the door latch, the alarm 151 is turned off as by the key operated switch 159 mounted within housing 13.

Alarm 151 may be a buzzer or bell or other signal device.

In FIG. 1, manual inward and outward movements of touch bar 109 are limited by the rubber stop cushions 161 upon base support brackets 25. These cushions further function to avoid metallic contact of touch bar 109 with the support bracket assembly 25–27.

Said support bracket assembly is sometimes referred to as a base support housing or just as a housing.

In the foregoing description reference has been made to a door latch assembly involving the combination with the door D within a door jamb J. Since the present latch assembly is equally applicable to windows, a window hinged upon one side is equivalent to said door and a window frame for said window with regard as equivalent to the present door jamb. The function and operation of the foregoing latch assembly is equally applicable.

In the foregoing description of one operative embodiment, the guard 53 has been described as being effective and useful particularly because with the normal bias applied to guard 53 as by spring 93, when the door is in an open position such as shown in FIG. 4, the guard blocks the lock aperture 51 of the latch 33. This means that with the door open, the guard 53 prevents the latch from locking, should someone manually pivot the latch from the position shown in FIG. 4 to the locking position as in FIG. 1. Without the guard 53, the present latch assembly will function well. However, without the guard 53 and without nothing blocking the latch aperture 51 with the door open, yoke 97 under its normal spring bias 91 could move to the solid line locking position shown in FIG. 11 with the pin 87–89 retaining nested within latch aperture 51. Latch 33 would be anchored against pivotal movement and the door D could not close past the strike 99.

With the guard 53 omitted, when the door D has been closed with respect to the jamb J, latch 33 is moved to its locking position and the yoke 67 automatically moves so that its retaining pin 89 moves into registry within latch aperture 51.

In the foregoing disclosure, the primary function of the yoke supported retaining pin assembly 87–89 is for locking nesting registry within latch aperture 51. Accordingly yoke 67 could be replaced by any other form of movable detent or latch retaining means which would be biased towards the latch and which would have an end or other projection or roller projected into retainingly registry within the latch aperture 51 for preventing rotation of said latch. Thus, the latch could not be rotated to an unlocked position, unless and until the retaining pin 87–89 or an equivalent projection were retracted to disengage from the latch aperture 51. An embodiment of such an assembly is shown in FIGS. 12 and 13.

In a latch assembly where the guard 53 is omitted, the biasing spring 93 is applied directly to the latch arm 45 so as to normally bias the latch 33 to the dash line position shown in FIG. 11.

MODIFICATION

A modified door latch assembly is schematically shown in FIG. 12. Latch 165 is pivotally mounted at 167 within housing 146 mounted upon door D in an upright position. Said latch has a corresponding lock chamber 37 at one end thereof adapted to receive the strike 99 which depends from the header or upper portion of the door jamb J, when the door has been rotated to a closed position. Said strike is retainingly nested within lock chamber 37 and interlocked with latch 165, FIG. 13.

The opposite end of the latch 167 has a cam surface 148 and formed therein a lock aperture 169 which corresponds to locking aperture 51 of the latch 33 shown in FIG. 5. In the embodiment shown in FIG. 12, the housing 146 is in an upright position with the cam portion 148 of the latch depending downwardly.

A latch retaining means, 171 in a form of rod or bar is guidably mounted within sleeve 173 within housing 146. A roller or other projection 175 is applied to or mounted upon the upper end of the latch retaining means 171 and is retainingly positioned within lock aperture 169 retaining the latch 165 against pivotal unlocking movement with respect to the strike 99, FIG. 13.

The latch retaining means or rod 171 is normally biased to the locking position shown by the compression spring 177 in axial registry with bar 171 and supported as at 179 against the guide sleeve 173.

Spring 181 mounted upon pivot pin 167 normally biases latch 165 toward open position, FIG. 12. Stop 183 within latch housing 146 limits pivotal opening movement of latch 165. Roller bearing 175 on bar 171 bears against cam surface 148, FIG. 12 reducing friction, and easing retraction of the bar 171 from its locking position, FIG. 13. FIGS. 12 and 13 are illustrative of top of the door latching, with rod 171 in a vertical position.

When door D is open, FIG. 12, spring 181 holds latch 165 in the correct position against stop 185 to accept strike 99 when door D is closed to the position shown in FIG. 13. Upon contact, strike 99 rotates latch 165 clockwise to locked position. Latch 165 remains locked and retained by bar 171, FIG. 13 until the bar is mechanically retracted by any operable means such as a knob, lever or push bar as above described.

When bar 153 is retracted and strike and latch are separated by opening the door, latch 165 is rotated by strike 99 toward the position indicated as "open", FIG. 12, further assisted by spring 181.

The latch assembly of FIG. 12 is also applicable to mortise type door locks, i.e., standard doors, if a guard were added, similar to the guard 53 described with respect to FIG. 11.

A simplified latch assembly is shown in FIGS. 14 and 15. Here latch 165 is held in correct position to accept strike 99, by bar 171 biased by gravity or counterweight into detent recess 185. Upon contact, strike 99 rotates latch 165 clockwise to locked position, FIG. 15. Bar 171 is biased to a locked position so as to rest within latch recess 169 retaining the latch locked. The door remains locked until control bar 171 is mechanically retracted by any operable means, such as a knob, lever or push bar.

In FIGS. 14 and 15 the latch assembly is shown in a simplified form without any spring bias applied to the latch. Here the latch 165 is held in correct position to accept strike 99 by the rod 171 biased by gravity or counter weight into the detent recess 185. On closing the door, contact between the strike 99 and the latch rotates the latch 165 to its locked position in FIG. 15. When rod 171 is retracted and strike and latch separated by opening the door, the latch is rotated by the strike toward the open position, FIG. 14 until rod 171 begins to enter detent 185. The force of the rod entering said detent causes the latch to rotate further in a counterclockwise direction retaining latch in the correct open position to accept strike 99, FIG. 14.

Any suitable means may be employed for retracting the latch retaining means or fod 171 when it is desired to unlock and open the door D. Such means have been above described as in FIG. 1 employing a touch bar 109. Said bar through a parallelogram linkage is adapted to retract the latch bar 103. Such means of retraction could also be applied to the latch retaining means or bar 171 shown in FIG. 12–15. Other mechanisms may be employed for retracting the latch retaining means 171 such as by the solenoid control 139 shown in FIG. 9 and applied to latch bar 137.

The rod 171, sometimes referred to as a latch retaining means, could be retracted by the operation of a knob or a handle operating a cable or any other suitable means which effects a retraction of the rod 171 so that it is disengaged from the latch aperture 169.

The structure, function and operation of the modified latch assemblies, FIGS. 12–15 is similar and relates to the door latch assembly described with respect to FIGS. 1 through 11.

In FIGS. 12 and 14 no guard is employed, nor is it necessary to employ a biasing spring directed to the latch 165 in FIG. 14.

Having described my invention, reference should now be had to the following claims:

I claim:

1. In the combination with a door hinged at one edge within a door jamb with a latch assembly mounted upon a closing edge and strike on said jamb registerable with said latch assembly, said latch assembly comprising a housing secured to said door;

a latch intermediate its ends pivotally mounted upon said housing upon a first axis and at one end projecting from said housing and having an outwardly opening lock chamber, there being a lock aperture within the other end of said latch;

said latch having a locking position registerable with and receiving said strike, and normally biased toward an unlocked position disengaged from said strike;

said strike on closing said door engaging and rotating said latch to its locking position;

a pivot member adjacent one end pivotally mounted upon said housing upon a second axis parallel to said first axis;

means biasing said pivot member toward a locking position, said pivot member being retractable to an unlocked position;

a lock pin upon said pivot member parallel to said second axis and adapted for interlocking retaining registry with said lock aperture when said latch is in its locking position;

a spring biased reciprocal latch bar within and mounted upon said housing, adjacent one end having an actuator engageable with said pivot member;

a movable means upon said housing connected to said latch bar for retracting said actuator for moving said pivot member to its unlocked position disengaging said latch;

said latch being free to move to its unlocked position on opening the door relative to said strike.

2. In the door latch assembly of claim 1, said first and second axes and lock pin lying in vertical planes, said latch and pivot member being movable in horizontal planes.

3. In the door latch assembly of claim 1, a guard adjacent said latch intermediate its ends pivotally mounted upon said housing upon said first axis; biased to a first position blocking said latch lock aperture and adapted on engagement with said strike for movement relative to said latch to a locking position uncovering said lock aperture.

4. In a door latch assembly of claim 3, said latch having a longitudinal slot, one end extending to said lock aperture and at its other end extending into said lock chamber;

said guard being nested within said slot and having a control arm extending into said lock chamber and engageable with said strike when the door is closed.

5. In the door latch assembly of claim 4, an angular detent on said control arm movably nested within said lock chamber in the path of relative movement of said door to said strike as the door is closed, said strike operatively engaging said detent rotating said guard to its locking position.

6. In the door latch assembly of claim 1, said lock chamber having an undercut area defining an elongated retaining lip on said latch;

said strike including an elongated body depending into said undercut area and throughout its length retainingly engaging said lip.

7. In the door latch assembly of claim 1, the pivotal mounting of said latch including a first pivot pin mounted upon and spanning said housing upon said first axis.

8. In the door latch assembly of claim 7, said pivot member including a pair of parallel spaced yoke arms;

the pivotal mounting of said pivot member including a second pivot pin mounted upon and spanning said housing upon said second axis;

said yoke arms being pivotally mounted upon said second pivot pin;

said lock pin spanning and secured to said yoke arms.

9. In the door latch assembly of claim 7, the pivotal mounting of said pivot member including a second pivot pin mounted upon and spanning said housing upon said second axis.

10. In the door latch assembly of claim 9, the biasing of said latch including a first coil spring mounted upon said first pivot pin at one end anchored to said housing and at its other end operatively engaging said latch.

11. In the door latch assembly of claim 3, the biasing of said latch including a first coil spring mounted upon said first pivot pin at one end anchored to said housing and at its other end operatively engaging said guard;

said guard having a roll pin extending laterally thereof normally spaced from said latch; said roll pin on pivotal movement of said guard adapted to operatively engage said latch.

12. In the door latch assembly of claim 9, the biasing of said pivot member including a coil spring mounted upon said second pivot pin and at one end anchored to said housing and at its other end operatively engaging said pivot member.

13. In the door latch assembly of claim 8, a cross pin interconnecting the one ends of said yoke arms in the path of retracting movement of said actuator and operatively engaged thereby for rotating said pivot member to its unlocked position.

14. In the door latch assembly of claim 1, a stainless steel lock roller mounted upon said lock pin adapted for registry within said lock aperture.

15. In the door latch assembly of claim 6, said strike including an elongated strike plate secured to said jam opposing said latch assembly;

said body extending from said strike plate centrally thereof including a boss spaced from said strike plate retaining said lip.

16. In the door latch assembly of claim 1, said housing having a longitudinal recess outwardly of and parallel to said door;

said movable means including an elongated touch bar movably nested within said housing recess spaced from and parallel to said latch bar;

a parallelogram linkage interposed between and pivotally connected to spaced portions of said touch bar and latch bar;

and a pair of parallel longitudinally spaced drive rockers at their one ends pivotally mounted upon said housing and at their other ends pivotally connected to said parallelogram linkage, whereby manual inward pressure applied to said touch bar along its length effects an inward movement of said touch bar and a corresponding retraction of said latch bar.

17. In the door latch assembly of claim 16, said housing having a base plate mounted along and secured to the interior surface of said door;

said latch bar being spaced from and slidably mounted upon said base plate.

18. In the door latch assembly of claim 17, the spacing of said latch bar from said base plate including nylon support rollers journaled upon said latch bar and engaging said base plate.

19. In the door latch assembly of claim 16, said parallelogram linkage including a pair of parallel drive yokes at their one ends pivotally connected to spaced under surface portions of said touch bar and at their other ends pivotally connected to said latch bar;

said drive yokes being inclined downwardly at an acute angle extending toward the direction of retraction of said latch bar;

said drive rockers at their said other ends being pivotally connected to said drive yokes intermediate their ends, but closer to said touch bar than to said latch bar.

20. In the door latch assembly of claim 19, the connection of said drive yokes to said touch bar including a pair of longitudinally spaced support channels on said touch bar extending into said housing;

said drive yokes being pivotally connected respectively to said support channels.

21. In the door latch assembly of claim 1, the biasing of said latch bar including an elongated coil spring extending between said latch bar and housing and at its ends connected thereto.

22. In the door latch assembly of claim 1, said movable means including a solenoid mounted upon said housing and having a reciprocal plunger pivotally connected to said latch bar for retracting said latch bar on energization of said solenoid.

23. In the door latch assembly of claim 1, an alarm assembly within said housing having a power source, a key operated actuating switch and an alarm contact;

an alarm actuating pin aligned with and spaced from said latch bar rearwardly thereof, guidably mounted upon said housing, normally spring biased to a position spaced from said alarm contact;

unauthorized retraction on said latch bar engaging and retracting said actuating pin into registry with said alarm contact.

24. In combination with a door hinged at one edge within a door jamb with a latch assembly mounted upon a closing edge and a strike on said jamb registerable with said latch assembly, said latch assembly comprising a housing secured to said door;

a latch intermediate its ends pivotally mounted upon said housing upon a first axis and at one end projecting from said housing and having an outwardly opening lock chamber, there being a lock aperture within the other end of said latch;

said latch having a locking position registerable with and receiving said strike, and normally biased toward an unlocked position disengaged from said strike;

said strike on closing said door engaging and rotating said latch to its locking position;

a latch retaining means normally biased toward a locking position and retractable to an unlocking position, movably mounted upon said housing and adapted for interlocking retaining registry within said lock aperture when said latch is in its locking position;

a reciprocal latch means within and mounted upon said housing, normally biased for movement in one direction, adjacent one end having an actuator engageable with said latch retaining means;

and a movable means upon said housing connected to said latch means for moving the latch means in the opposite direction to its unlocked position disengaging said latch;

said latch being free to move to its unlocked position on opening of the door relative to said strike;

said latch retaining means including a pivot member adjacent one end pivotally mounted upon said housing upon a second axis parallel to said first axis;

means biasing said pivot member toward a locking position, said pivot member being retractable to an unlocked position;

and a lock pin upon said pivot member parallel to said second axis and adapted for interlocking retaining registry within said lock aperture when said latch is in its locking position.

25. In the latch assembly of claim 24, said pivot member being a yoke.

26. In the latch assembly of claim 1, said pivot member being a yoke.

27. In the door latch assembly of claim 1, an alarm assembly within said housing having a power source, a key operated actuating switch and an alarm contact;

an alarm actuating means spaced from said latch bar and from said alarm contact;

unauthorized retraction on said latch bar retracting said actuating means into registry with said alarm contact.

* * * * *